United States Patent [19]

Tsukimoto et al.

[11] Patent Number: 4,489,644

[45] Date of Patent: Dec. 25, 1984

[54] MULTIPLE CONTROL VALVES

[75] Inventors: Toshiaki Tsukimoto, Zama; Chiharu Matsunaga; Yutaka Hashimoto, all of Ayase, Japan

[73] Assignee: Toshiba Kikai Kabushiki Kaisha, Tokyo, Japan

[21] Appl. No.: 402,854

[22] Filed: Jul. 29, 1982

[30] Foreign Application Priority Data

Aug. 6, 1981 [JP] Japan ..... 56-117256
Aug. 6, 1981 [JP] Japan ..... 56-117257

[51] Int. Cl.[3] ..... F15B 13/08

[52] U.S. Cl. ..... 91/530; 137/596.12; 137/596.13

[58] Field of Search ..... 137/596.13, 596.12; 91/530

[56] References Cited

U.S. PATENT DOCUMENTS 3,008,488 11/1961 Vander Kaay et al. ..... 137/596.12
3,481,364 12/1969 Hodgson et al. .

*Primary Examiner*—Gerald A. Michalsky
*Attorney, Agent, or Firm*—Koda and Androlia

[57] ABSTRACT

A multiple control valve for operating a civil construction machine or the like comprises a valve body, at least two parallel direction change-over plungers assembled in the valve body, by-pass passages and fluid supply passages formed in the valve body and operatively communicated with the plungers for feeding fluid from an external source to the plungers. One of plungers disposed most downstream side of the multiple control valve is provided with inner passages arranged on both sides thereof, a passage crossing the plunger, an axial passage having one end closed and the other end opened towards one of the inner passages, and a lateral port communicated with the inner passage. The crossing passage is communicated with the axial passage at a portion near the closed end thereof. When the most downstream side plunger is displaced from its neutral position in a direction to operate a corresponding actuator for operating a mechanism of the machine in a predetermined direction, the crossing passage intercommunicates with one of the supply passage and the lateral port intercommunicates with the by-pass passage and when the most downstream side plunger and another plunger disposed upstream side thereof are simultaneously displaced in the direction described above, only the connection between the crossing passage and one of the supply passages is established.

3 Claims, 2 Drawing Figures

MULTIPLE CONTROL VALVES

BACKGROUND OF THE INVENTION

This invention relates to a multiple control valve for controlling the operation of, for example, a hydraulic power shovel of a civil construction machine or vehicle.

A hydraulic power shovel generally comprises a lower travelling portion and an upper rotating portion including an operator's cab, a boom, an arm, and a bucket, and a multiple control valve of the power shovel comprises a plurality of parallelly arranged plungers which hydraulically control respective portions of the power shovel. With the multiple control valve of this type, which requires at least two plungers, i.e. direction change-over valves, when the plungers for rotating the rotary portion and operating the arm of the power shovel are changed over to thereby simultaneously operate the rotary portion and the arm, and in this case, when a load applied to the arm is small, a sufficient pumping pressure cannot be obtained, and therefore, a pressure for rotating the rotary portion cannot be maintained at a sufficient value, and sometimes, there arises a case where the rotating operation cannot be performed. In a prior art control valve, in order to obviate this defect, a multiple control valve is provided with a valve having a throttling function between parallel circuits connecting plungers for rotating the rotary portion and the arm of the shovel so as to maintain a desired rotating pressure in a case when a light load is applied on the arm.

However, the provision of such valve between the parallel circuits requires a space in the multiple control valve which unwillingly enlarge the valve body thereof, and moreover, in a case where only the plunger for operating the arm is operated, since the fluid in the plunger for rotation is fed into the arm plunger through the throttle valve, unnecessary pressure loss would be caused.

SUMMARY OF THE INVENTION

An object of this invention is to obviate the defects encountered in the prior art and to provide an improved multiple control valve comprising a compact valve body and capable of reducing pressure loss of control fluid and always securing fluid pressure suitable for operating an actuator of, for example, a civil construction machine.

According to this invention, there is provided a multiple control valve for operating a construction vehicle or the like of the type comprising a valve body provided with at least two parallel holes for receiving direction change-over plungers, by-pass passages arranged at a central portion of the valve body in a direction perpendicular to the holes and operatively connected to the plungers for feeding fluid from an external source to the plungers, fluid supply passages arranged parallelly with the by-pass passages for supplying fluid from the source to the plungers, one of the supply passages being provided with an annular chamber at its endmost portion operatively communicated with one of the plungers arranged at the most downstream side of the multiple control valve, a return passage operatively connecting the fluid source to external actuators of the construction vehicle, and cylinder ports operatively connecting corresponding plunger holes to corresponding actuators, each of the plungers being provided with inner passages arranged on both sides thereof, the inner passages being operatively connected to corresponding ones of the cylinder ports through axial holes provided for the plunger, and the multiple control valve is characterized in that one of the plungers disposed at the most downstream side of the multiple control valve comprises a passage crossing this plunger and having opened ends, an axial passage having one end closed and the other end opened towards one of the inner passages, and a lateral port communicated with one of the inner passages, the crossing passage being communicated with the axial passage means at a portion near the closed end thereof, and that when only the plunger disposed at the most downstream side is displaced from the neutral position in a direction to operate corresponding one of the actuators in one predetermined direction, the crossing passage communicates with the annular chamber of the supply passage and the lateral port communicated with the central by-pass passage, and when the most downstream plunger and another one of the plungers disposed upstream side of the first mentioned plunger are simultaneously displaced in the direction, only the connection between the crossing passage and the annular chamber is established.

DESCRIPTION OF THE PREFERRED EMBODIMENTS

Figure 1:
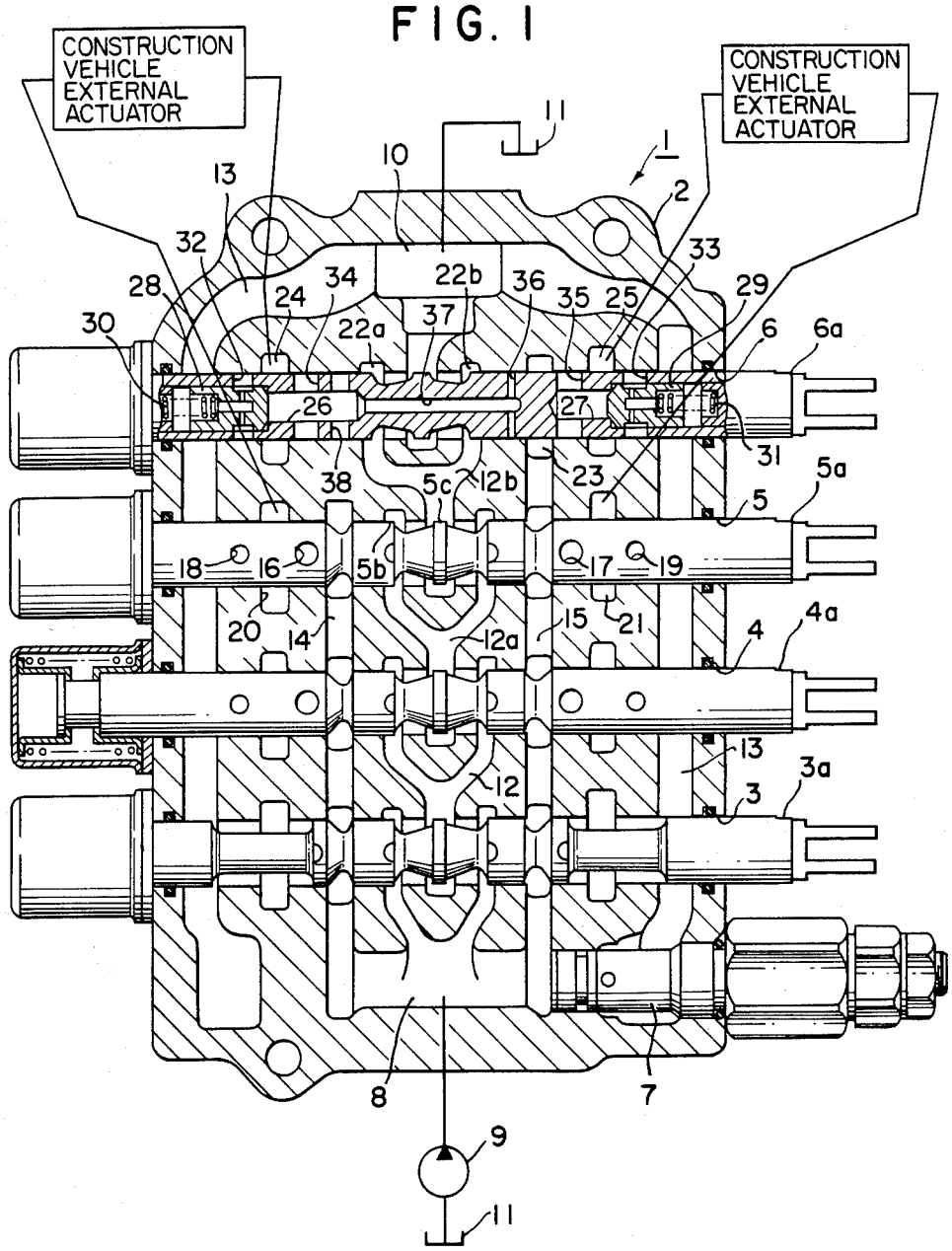
FIG. 1 shows a vertical section, partially simplified, of a multiple control valve according to this invention.

Referring to FIG. 1, a multiple control valve 1 embodying the invention comprises a valve body 2 provided with a plurality of plunger holes 3, 4, 5 and 6 into which are assembled plungers 3*a*, 4*a*, 5*a* and 6*a* which respectively control a travelling motor for a lower travelling portion of a power shovel, a boom cylinder for operating a boom thereof, a rotary motor for rotating the upper rotary portion of the power shovel, and for operating an arm member thereof. A relief valve 7 is attached to the valve body 2 for protecting the control valve so that the fluid pressure will not exceed a predetermined pressure value. A fluid inlet chamber 8 and a fluid outlet chamber 10 are provided for the valve body 2 at its upstream and downstream sides. The inlet chamber 8 is communicated with a fluid tank 11 through a pump 9 and the outlet chamber 10 is also connected to the tank 11. These chambers are operatively intercommunicated through a central by-pass passage 12 which is perpendicular to the plunger holes at a time when the plungers 3*a* through 6*a* are maintained at their neutral positions as shown in FIG. 1. The plungers 4*a* and 5*a* and the plungers 5*a* and 6*a* are respectively intercommunicated through by-pass passages 12*a* and 12*b*. A return passage 13 connects the tank 11 and an external actuator for operating the shovel, and fluid supply passages 14 and 15 are formed in the valve body 2 on both sides of the central by-pass passage 12 to supply fluid to the plungers. The plunger 5*a* is provided with fluid ports 16, 18 and 17, 19 which are respectively intercommunicated through passages, not shown. The plunger 5*a* is also provided with passages 20 and 21 for passing the pressurized fluid for operating the rotary motor.

The by-pass passage 12*b* is provided with annular chambers 22*a* and 22*b* across the plunger hole 6 and the annular chambers 22*a* and 22*b* are somewhat displaced leftwardly with respect to the centerline of the by-pass passage 12, as viewed in FIG. 1. The supply passage 15 has a chamber 23 at its uppermost portion communicated with the plunger hole 6, but the supply passage 14 is not provided with such chamber. The valve body 2 is provided with passages 24 and 25 communicated with the plunger hole 6 for supplying pressurized fluid to a hydraulic cylinder assembly, i.e. the actuator, for operating the arm of the power shovel and the plunger 6*a* is provided on both sides thereof with inner stepped passages 26 and 27 which are opened towards both ends thereof. Poppets 28 and 29 inserted into the passages 26 and 27 are forced inwardly by spring means 30 and 31 disposed between the rear ends of the poppets and plugs, not shown, for closing one ends of the passages 26 and 27. The plunger 6*a* is provided with axial holes 32, 33 and 34, 35 which are opened towards the inner passages 26 and 27 and towards the outer periphery of the plunger 6*a*. The plunger 6*a* is further provided with an axial passage 37 having one end communicated with the passage 26 and the other end closed. A lateral port 38 opened towards the outer periphery of the plunger 6*a* is provided for the passage 26 at a portion near the end opening of the passage 37 and a passage 36 having ends opened towards the periphery of the plunger 6*a* for throttling the flow of fluid is provided near the closed end of the passage 37 so that the port 38 is connected to the annular chamber 22*a* of the by-pass passage 12*b*, and the throttle passage 36 is communicated with the annular chamber 23 of the supply passage 15 when the plunger 6*a* is shifted rightwardly as viewed in FIG. 1, i.e. in a direction for operating the external actuator in a predetermined direction, from the position shown in FIG. 1.

The multiple control valve according to this invention operates as follows.

When the plunger 6*a* for operating the arm member of a power shovel is displaced rightwardly from the position shown, the port 38 and the passage 36 of the plunger 6*a* are communicated with the annular chambers 22*a* and 23, respectively, whereby pressurized fluid fed into the supply passage 15 flows into the inner passage 26 through the throttle passage 36 and the axial passage 37 and pressurized fluid fed into the by-pass passage 12 (12*a*, 12*b*) also flows into the passage 26 through the port 38. The fluid fed into the passage 26 opens the poppet 28 against the biasing force of the spring 30 and then flows into the external actuator for operating the arm member through the hole 32 and the passage 24, and in this operation, return fluid flows from the actuator into the inner passage 27 of the plunger 6*a* through the passage 25 and the hole 35 to open the poppet 29 against the biasing force of the spring 31 and finally returns into the return passage 13.

As described hereinabove, the pressurized fluid can be supplied into the inner passage 26 of the plunger 6*a* through two passages, one from the supply passage 15 through the axial passage 37 and the other from the by-pass passage 12 through the port 38, so that pressure loss can be minimized in a case where only the plunger 6*a* is rightwardly displaced and the pressurized fluid is fed from the plunger 5*a* to the plunger 6*a*.

On the other hand, when the plunger 6*a* is shifted leftwardly from its neutral position, the plunger 6*a* performs the same function as those of the plungers 3*a*, 4*a* and 5*a*, that is, the pressurized fluid in the supply passage 15 flows through the hole 35 and the passage 25, and the return fluid flows into the return passage 13 through the passage 24, the hole 34, and the poppet 28.

When the plungers 6*a* and 5*a* are simultaneously displaced rightwardly from the neutral positions shown in FIG. 1, the connection between the by-pass passages 12*a* and 12*b* is cut out by a shoulder 5*b* and a land 5*c* of the plunger 5*a* and the fluid path from the by-pass passage 12 is also shut out, whereby the amount of fluid to be fed into the passage 24 is limited to a relatively small amount of fluid passing only through the supply passage 15 and the throttle passage 36. At this time, the connections between the fluid supply passage 14 and the port 16 and between the passage 21 and the port 17 are established, so that the pressurized fluid in the supply passage 14 is fed to a cylinder assembly for operating the rotary motor through ports 16 and 18 and the passage 20, and the return fluid returns into the return passage 13 through the passage 21 and the ports 17 and 19. As described above, the fluid flow from the by-pass passage 12 towards the inner passage 26 of the plunger 6*a* is shut out and the pressurized fluid only in the supply passage 15 is fed into the passage 26 through throttle passage 36, so that the pressure predetermined for rotating the operating portion of the shovel can be secured even in a case where load pressure applied on the arm member were relatively low.

Figure 2:
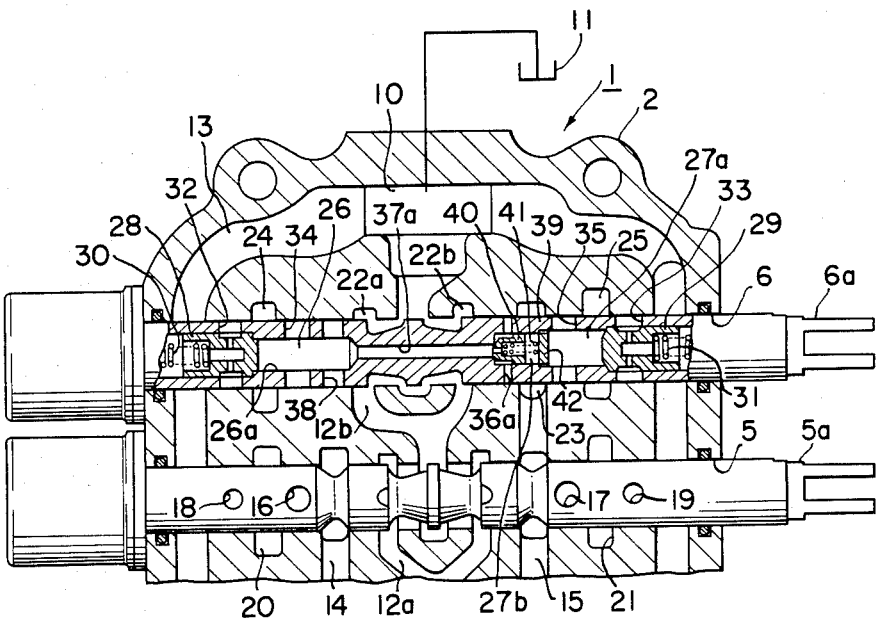
FIG. 2 is a partial sectional view of one modification of the multiple control valve shown in FIG. 1.

FIG. 2 is a partial sectional view of a modification of a multiple control valve according to this invention, in which like reference numerals are applied to members or portions corresponding to those shown in FIG. 1. In this modification, the plunger 6*a* is provided with an axial passage 37*a*, a passage 36*a* crossing the plunger 6*a*, and an inner passage 27*a* which respectively correspond to the passages 37, 36 and 27 shown in FIG. 1. In this embodiment, the passages 27*a* and 37*a* are intercommunicated through a passage 27*b* formed therebetween and a relief valve 39 is disposed in this passage 27*b*. The relief valve 39 comprises a poppet 40 slidably inserted in the passage 27*b* so that one end of the relief valve 39 is urged against one opened end of the axial passage 37*a* by a spring 41 disposed between the other end of the relief valve 39 and a plug disposed in the passage 27*b* to cut out the connection between the passages 27*a* and 27*b*, thereby to cut out the connection between the crossing passage 36*a* and the passage 37*a* under a condition illustrated in FIG. 2.

With the embodiment shown in FIG. 2, when the plungers 5*a* and 6*a* are simultaneously displaced rightwardly from the position shown, the connection between the by-pass passage 12 and the inner passage 26 is cut out and the fluid only in the supply passage 15 flows into the passage 26 through the passage 36*a*, the relief valve 39, and the axial passage 37*a*. Thus, a pressure predetermined for rotating operation of a power shovel can always be secured by the provision of the relief valve 39.

What is claimed is:

1. In a multiple control valve for operating a construction vehicle and the like of the type comprising a valve body provided with at least two parallel holes for receiving direction change-over plungers, by-pass passage means arranged at a central portion of said valve body in a direction perpendicular to said holes and operatively connected to said plungers for feeding fluid from an external source to said plungers, fluid supply passage means arranged parallelly with said by-pass passage means for supplying fluid from said source to said plungers, said supply passage means being provided with an annular chamber at its endmost portion operatively communicated with one of said plungers arranged at the most downstream side of the multiple control valve, return passage means operatively connecting said fluid source to external actuators of the construction vehicle, and cylinder ports operatively connecting corresponding plunger holes to corresponding actuators, each of said plungers being provided with inner passages arranged on both sides thereof, said inner passages being operatively connected to corresponding ones of said cylinder ports through axial holes provided for said plunger, the improvement in which said one of the plungers disposed at the most downstream side of the multiple control valve comprises passage means crossing said one plunger and having opened ends, axial passage means having one end closed and the other end opened towards one of said inner passages, and a lateral port communicated with said one of inner passages, said crossing passage being communicated with said axial passage means at a portion near said closed end thereof, and in which when only said plunger disposed at the most downstream side is displaced from the neutral position in a direction to operate corresponding one of said actuators in one predetermined direction, said crossing passage communicates with said annular chamber of said supply passage and said lateral port communicates with said central by-pass passage, and when said most downstream plunger and another one of said plungers disposed upstream side of said first mentioned plunger are simultaneously displaced in said direction, only the connection between said crossing passage and said annular chamber is established.

2. The multiple control valve according to claim 1 wherein said crossing passage is constructed as a throttle passage.

3. The multiple control valve according to claim 1 wherein said axial passage is communicated with another one of said inner passages of said downstream-side plunger through an axial inner hole and a relief valve is inserted into said inner hole in a manner that one end of said relief valve is caused to abut to an opened end of said axial passage by spring means disposed between another end of said relief valve and a plug disposed in said inner hole so as to cut out the communication of said inner passage and said another one of said inner passages, whereby said relief valve is operatively connected to said axial passage and said crossing passage.

* * * * *